US005607577A

United States Patent [19]

Koszarycz et al.

[11] Patent Number: 5,607,577

[45] Date of Patent: Mar. 4, 1997

[54] PREVENTION OF SULFUR GAS EMISSIONS FROM A ROTARY PROCESSOR USING LIME ADDITION

[75] Inventors: Roman Koszarycz; William Taciuk; Adrian Begley, all of Calgary, Canada

[73] Assignee: Alberta Oil Sands Technology and Research Authority, Edmonton, Canada

[21] Appl. No.: 264,094

[22] Filed: Jun. 21, 1994

[30] Foreign Application Priority Data

Oct. 25, 1993 [CA] Canada ..... 2109176

[51] Int. Cl.[6] ..... C10G 1/00

[52] U.S. Cl. ..... 208/391; 208/390

[58] Field of Search ..... 208/177, 391, 208/390

[56] References Cited

U.S. PATENT DOCUMENTS

| | | | |
|---|---|---|---|
| 4,246,245 | 1/1981 | Abrams et al. | 423/242 |
| 4,280,879 | 7/1981 | Taciuk | 202/110 |
| 4,285,773 | 8/1981 | Taciuk | 202/110 |
| 4,424,197 | 1/1984 | Powell | 423/244 |
| 4,563,246 | 1/1986 | Reed et al. | 202/110 |
| 4,616,574 | 10/1986 | Abrams | 110/343 |
| 5,217,578 | 6/1993 | Taciuk | 202/110 |

OTHER PUBLICATIONS

Lyngfelt et al., Sulphur capture in fluidised–bed combustors: temperature dependence and lime conversion, Journal of the Institute of Energy, Mar. 1989, pp. 62–72.

Kovacik et al, $H_2$ Capture in Coal Gasification Using Calcium Based Sorbents, ARC CSChE Proceedings, 1991.

Nguyen et al., Sulphur Capture During Gasification of Oil Sand Cokes, the Canadian Journal of Chemical Engineering, vol. 71, Jun. 1993, pp. 401–410.

Z. M. George et al., Coking of bitumen from Athabasca oil sands., Alberta Research Council, Council, Contribution No. 1068, May 27, 1981.

*Primary Examiner*—Helane Myers

*Attorney, Agent, or Firm*—Millen, White, Zelane & Branigan, P.C.

[57] ABSTRACT

Oil sand is treated to prevent the production of sulfur dioxide ("$SO_2$") from a known rotating kiln-type processor. Lime or calcium oxide ("CaO") is added with the oil sand feed to the kiln. In the kiln, the CaO is mixed with the sulfur-containing bitumen of the oil sand and preheated. The preheated mixture is then pyrolysed, forming coke which is modified by the added CaO to reduce its tendency to produce $SO_2$ when combusted. The modified coke is then combusted with air, producing substantially no $SO_2$.

11 Claims, 3 Drawing Sheets

PREVENTION OF SULFUR GAS EMISSIONS FROM A ROTARY PROCESSOR USING LIME ADDITION

FIELD OF THE INVENTION

This invention relates to a process for treating sulfur-containing hydrocarbons borne on inorganic host particles which are subjected to pyrolysis to produce modified coke containing sulfur, so that there is a reduced tendency to produce sulfur dioxide when the coke is combusted. The process involves use of a particular rotary kiln processor and a calcium oxide additive.

BACKGROUND OF THE INVENTION

The present invention is concerned with improving a specific known process carried out in a specific known rotary kiln processor, to recover hydrocarbons from oil sand. This processor is known in the industry as the "ATP processor" and will be referred to in this disclosure by that terminology. In the claims, the processor is referred to as "a rotary kiln processor". The process and processor are further described in U.S. Pat. No. 4,280,879, issued to William Taciuk. The oil sand referred to comprises sand associated with water and bitumen hydrocarbons containing sulfur.

The present invention is directed toward suppressing sulfur dioxide emissions from the processor. Relevant prior art processes are disclosed in Canadian Patent No. 1,156,953, issued to Kessick et al (modifying sulfur in coke) and in U.S. Pat. No. 4,424,197 issused to Powell et al ($SO_2$ capture).

Returning to the ATP processor, it comprises inner and outer, generally tubular members herein referred to as tubes. The tubes are generally coextensive, concentric, spaced apart and horizontal. They are interconnected so as to form a unitary rotatable assembly. Stationary end frames seal the first and second ends of the outer tube. Drive means are provided for rotating the outer tube, and thus the entire assembly, about its longitudinal axis. A passageway extends longitudinally through the inner tube and an annular passage is formed between the tubes. The inner tube passageway is closed at its first end by a stationary end frame and at the second end by a vertical closure plate. It is divided along its length by an upright baffle, thereby creating two segregated sequential chambers or "zones" which combine to extend between the first and second ends of the inner tube. The zone at the first end is referred to as the "preheat zone" and that at the second end as the "vaporization zone". A feed stream comprising particulate solids may be fed into the first end of the preheat zone by means of a conveyor extending through the first end stationary end frame. As the tube assembly is rotated, this feed is advanced longitudinally through the inner tube passageway. As it is advanced, the feed is simultaneously cascaded. In addition, as it moves through the preheat zone the feed is heated by heat exchange with the wall of the inner tube. The inner tube is heated by hot solids and flue gases moving countercurrently through the annular space. (The manner in which the hot solids and flue gases are provided is described below). As a result of progressive heating of the feed during its advance through the preheat zone, contained water is vaporized. The produced steam is suctioned from the preheat zone by a gas compressor and conduit assembly communicating with the zone at its first end. Thus, in the preheat zone the solids are mixed as they cascade, the feed is progressively heated and water is vaporized, and the atmosphere in the vicinity of the baffle is caused to be substantially oxygen-free, due to the back flow of steam. The preheated feed is discharged from the preheat zone through helical chutes extending through the baffle. The chutes lead into the vaporization zone. On entering the vaporization zone, the preheated feed is mixed with hot solids recycled from the annular space. As a result, the feed is now heated to a relatively high temperature. The hydrocarbon associated with the solids is therefore vaporized and thermally cracked and some coke is formed on the solid particles. A second gas compressor and conduit assembly, communicating with the second end of the vaporization zone, suctions the hot gases from the zone and draws them through a condenser. The coked solids are discharged from the second end of the vaporization zone by means of a helical chute extending through the closure plate at the second end of the inner tube. The coked solids are discharged into the second end of the annular space. The annular space provides combustion and cooling zones extending sequentially from the second end to the first end thereof. Air is injected through the second stationary end frame into the combustion zone. In addition, a gas burner also extends through the second end frame and supplies supplemental heat to the combustion zone. Lifters extend inwardly from the inner surface of the outer tube along its length. In the combustion zone, these lifters lift and drop the coked solids through the injected air stream. In the course of this, the coke combusts, producing flue gases, and the solids are further heated. The resulting hot solids are advanced longitudinally through the annular space from its second end toward its first end. A portion of these hot solids are recycled, by means of a helical chute, from the first end of the combustion zone into the first end of the vaporization zone, as was previously described. The balance of the hot solids advance into the annular cooling zone, which is coextensive with the preheat zone of the inner tube. Here the hot solids are repeatedly lifted and dropped onto the outer surface of the preheat section of the inner tube. Thus the preheat section is heated by contact with the shower of hot solids and the flow of hot flue gases moving through the cooling zone. At the same time the hot solids and flue gases are correspondingly cooled, thus recovering useful heat from them. The cooled solids are discharged from the cooling zone through the first end frame by means of a chute. The flue gases are removed from the annular space by a fan and conduit assembly communicating with the first end of the annulus.

In summary then, the ATP processor carries out the following when fed oil sand:

- progressively preheating the oil sand feed by heat exchange through the tube wall to vaporize the water contained in the feed;
- pyrolysing the preheated feed in the vaporization zone by mixing it with recycled hot combusted sand, thereby vaporizing and thermally cracking hydrocarbons entrained in the feed, to produce coked sand and oil vapours;
- transporting hot solids into and out of the vaporization zone by means of chutes, essentially preventing the movement of vapours from and into the zone;
- heating and burning the coked sand in the combustion zone, to provide a portion of the process heat and produce clean hot sand;
- recycling part of the hot sand into the vaporization zone to provide required heat;
- separately collecting the steam and hydrocarbon vapours from the preheat and vaporization zones and separately condensing them to yield in the second case an oil fraction in liquid form;

lifting and dropping hot sand onto the inner tube wall in the cooling zone, to supply required heat to the tube wall for conduction into the preheating zone;

discharging clean sand from the cooling zone as a tailings stream; and discharging flue gases from the annular space for treatment as a waste stream.

This known process, as just described, is referred to in the claims as "process comprising treating oil sand . . . in a rotating kiln-type processor to recover hydrocarbons".

Unfortunately, the combustion of coke in the ATP processor is accompanied by troublesome production of sulfur-containing gases. A portion of the sulfur, originating from the feed bitumen, ends up in the coke. When combusted, the sulfur-containing coke releases $SO_2$ with the flue gases, requiring expensive flue gas treatment equipment to remove the environmentally noxious gas.

Turning now to the prior art Kessick et al process, it involves:

combining calcium oxide or calcium hydroxide to a heavy oil containing sulfur in the molar ratio of calcium to sulfur in the feed ("Ca:S") of 1:1 to 1:3 to form a mixture; and coking said mixture to form coke having a decreased tendency to produce $SO_2$ (capturing up to 80% of the sulfur-containing gases) upon subsequent combustion in air.

Several functional differences between the process of Kessick et al and the ATP processor raised questions of whether adequate sulfur capture could be achieved with the low Ca:S ratios disclosed. Firstly, a capture of only 80% would be insufficient to permit elimination of the $SO_2$ removal equipment. Secondly, in contrast to Kessick et al, the bitumen (heavy oil) component of the ATP processor feed is widely dispersed on about ten times its weight of solids, further casting doubt on the capabilities of even achieving an 80% capture. Lastly, Kessick et al did not anticipate retorting in the unconventional vaporization zone of the ATP processor; greater contacting densities of a delayed or fluidized bed coker being preferred.

The prior art Powell et al process involves:

contacting $SO_2$-containing gas in a fluidized bed or packed column reactor of highly porous particles of calcium oxide; and reacting the $SO_2$-containing gas with the calcium oxide at 500° to 1000° C. to form calcium sulfate ("$CaSO_4$").

Early experiments, which attempted direct application of the process of Powell et al to the ATP processor, resulted in unsatisfactory results. Addition of calcium oxide to the combustion zone resulted in only about a 60% capture of sulfur-containing gases which was insufficient to suggest elimination of the expensive $SO_2$ removal equipment.

SUMMARY OF THE INVENTION

The present invention involves a novel, continuous process for substantially preventing sulfur dioxide ("$SO_2$") emissions when practised in the described ATP processor. The present invention was developed for a particular feedstock, oil sand, although it is not so limited.

With the addition of calcium oxide ("CaO") to oil sand feed, in amounts higher than claimed in the prior art, a surprising effective capture of sulfur-containing gas emissions is achievable. Using a calcium to sulfur in the feed ("Ca:S") molar ratio of greater than 1:1, substantially 100% of sulfur-containing gases are captured, sufficient in most cases to justify elimination of the $SO_2$ removal equipment.

The CaO treatment of oil sand in the ATP processor is unique from the processes practised in the prior art in that:

bitumen is never segregated into a liquid form for mixing with sulfur modifying reagents;

the whole oil sand feed is subjected to, retorting conditions;

gases produced from retorting are not intimately contacted with sulfur modifying reagents, as is the case with fluidized bed cokers;

coked byproducts, produced from retorting, are formed as a layer upon inorganic solids, typically comprising fewer than 10 weight % on the solids;

coked byproducts are combusted in a low density particle cascading combustion zone, not in a dense, fluidized bed combustor.

The process comprises:

adding CaO to oil sand containing sulfur, to provide a continuous processor feed stream;

advancing the processor feed stream through the preheat zone of the ATP processor, thereby dispersing the added CaO throughout the feed, forming a mixture, progressively heating the feed from ambient temperature to about 250° C., and vaporizing any water in the feed;

suctioning the gases produced in the preheat zone using compressor and conduit means communicating with the first end of the said zone, whereby there is a back flow or countercurrent movement of the produced gases, relative to the direction of advance of the feed;

advancing the preheated feed stream into the vaporization zone and mixing it therein with recycled hot solids to raise the temperature of the feed above about 480° C., preferably to about 525° C., thereby vaporizing and cracking contained oil and forming coked solids containing calcium and sulfur compounds;

suctioning produced gases from the second end of the vaporization zone and condensing them to yield liquid condensate;

advancing the coked solids into the combustion zone, injecting air and adding heat to said zone to burn coke and yield hot solids preferably having a temperature of about 730° C. and producing flue gases containing substantially no $SO_2$;

recycling a sufficient portion of the hot solids from the first end of the combustion zone, into the first end of the vaporization zone, to heat the feed stream as previously stated;

providing chutes at the first and second ends of the vaporization and combustion zones, providing movement of solids from zone to zone, essentially preventing the movement of vapours from leaving the vaporization zone, or oxygen containing gases from entering the vaporization zone;

advancing the balance of the hot solids and flue gases through the cooling zone and lifting and dropping the hot solids onto the preheat tube to heat the feed stream passing therethrough and to cool the solids passing through the cooling zone;

discharging the solids reaching the first end of the cooling zone; and suctioning gases from the first end of the cooling zone, removing entrained solids, and condensing waters of combustion to yield solids, liquid condensate, and waste gases substantially free of $SO_2$.

In accordance with the invention, the CaO is processed with sulfur-containing bitumen under novel conditions and procedures, to thereby substantially prevent the production of $SO_2$ upon pyrolysis of bitumen and the subsequent combustion of the formed coke. More particularly:

continuous cascading or mixing of fresh oil sand and CaO in the preheat zone is conducted to achieve a desirable mixing of the CaO throughout the widely dispersed bitumen, a portion of the CaO becoming hydrated to calcium hydroxide ("$Ca(OH)_2$");

advancement of the oil sand mixture to the vaporization zone and mixing it with a recycle stream of hot coked solids, to raise the temperature of the feed stream sufficiently so that hydrocarbons are pyrolysed and the product is suctioned from the zone as a gas, thereby separating the hydrocarbons and forming coked product on the solids;

in conjunction with the pyrolization, the CaO and $Ca(OH)_2$ react to become intimately associated in a modified calcium product form with the coked product;

after pyrolization, the coked product is combusted in the combustion zone, the modified calcium product acting to capture substantially all of the sulfur released from the combusted coke to yield a flue gas product substantially free of $SO_2$, and a stable calcium-sulfur product associated with the solids; and a portion of the coked product and residual modified calcium product which is recycled to the vaporization zone as previously stated.

The process has been found capable of continuously processing oil sands containing sulfur to capture substantially all of the sulfur that would otherwise be produced as $SO_2$ and require expensive treatment.

DESCRIPTION OF THE PREFERRED EMBODIMENT

Figure 1:
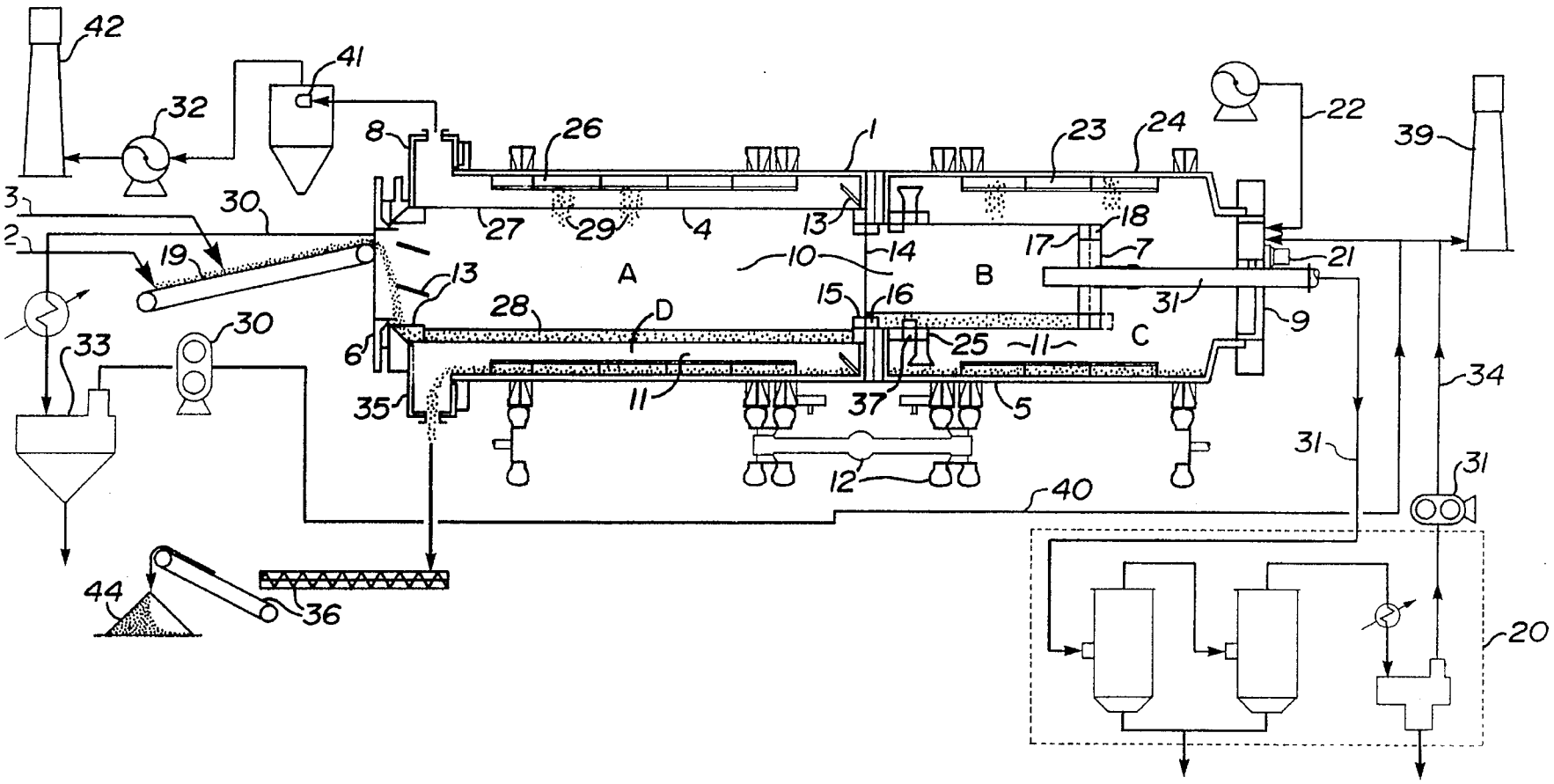
FIG. 1 is a schematic drawing showing the ATP processor in side elevation.

The invention has been demonstrated in a pilot run using an ATP processor 1 as shown in FIG. 1.

The processor 1 comprised inner and outer tubular members 4 and 5. The first end of the inner tubular member 4 was sealed by a first stationary end frame 6. The second end of the inner tubular member 4 was sealed by a closure plate 7. The first and second ends of the outer tubular member 5 were sealed by second and third stationary end frames, 8 and 9 respectively.

The inner tubular member 4 formed an internal passageway 10 which consisted of sequential preheat and vaporization zones A and B extending between said member's first and second ends.

The outer tubular member 5 was generally coextensive, concentric and radially outwardly spaced from the inner tubular member 4. An annular space 11 was thus formed between the tubular members 4 and 5. This space 11 comprised combustion and cooling zones C and D extending sequentially between the second and first ends of the outer tubular member 5.

The tubular members 4 and 5 were structurally interconnected so that they would rotate together. A drive system 12 was provided for rotating the outer tubular member 5 about its longitudinal axis.

Inwardly protruding, angled plates 13 were affixed to the inside surfaces of the inner and outer tubular members 4 and 5 for assisting in advancing or retarding particulate solids flow through the passageway 10 and annular space 11.

A vertical baffle 14 separated and isolated the preheat zone A from the vaporization zone B. An open-ended chute 15 extended through the baffle 14 at its periphery, for enabling particulate solids to move from the preheat zone A into the vaporization zone B. The flow of gases through the chute 15 was essentially prevented by the charge of solids present in the chute passage 16 at any given moment.

An open-ended chute 18 extended through the second closure plate 7 at its periphery, for moving coked solids from the vaporization zone B in to the combustion zone C. Again, the movement of gases between the zones B, C was precluded by the combination of the closure plate 7 and the solids charge in the chute 18.

A conveyor 19 extended through the first end frame 6, for delivering oil sand feed 2 and calcium oxide ("CaO") 3 to the passageway 10. Thus feed 2 and CaO 3 could be introduced into the first end of the preheat zone A.

A burner 21 extended through the third end frame 9, for supplying supplemental heat to the combustion zone C. In addition, air pipes and air fan assembly 22 extended through the third end frame 9, for supplying a flow of pressurized air to the combustion zone C.

Lifters 23 were provided, attached to the wall 24 of the outer tubular member 5 along its inside surface through the length of the combustion zone C. The lifters 23 were adapted to lift coked solids and drop them through the curtain of air being injected into the combustion zone by the air pipes and air fan assembly 22.

Thus, in the combustion zone C the coked solids were lifted and dropped in the injected air and heated, thereby initiating combustion of the coke to raise the temperature of the solids particles.

Some of the hot solids issuing from the combustion zone C were recycled into the first end of the vaporization zone B by the open-ended chutes 25. Advancing solids within the chute passage 37 essentially blocked the free transference of vapours from one zone to the other. The balance of the hot solids were advanced into the cooling zone D.

Lifters 26 were also provided in the cooling zone D, attached to the wall 24 of the outer tubular member 5 at its inside surface. The lifters 26 were adapted to lift the hot solids moving through the zone and drop them on the preheat wall portion 27 of the inner tubular member 4.

Thus heat was transferred to the bed 28 of feed advancing through the preheat zone A. The heat was absorbed by the preheat portion wall of the inner tubular member 4 from the hot flue gases moving through the cooling zone D and by contact with the hot solids 29 contacting the wall 27. The absorbed heat moved through the wall 27 and was transferred to the particles of the bed 28, thereby progressively heating the bed in the course of its passage through the preheat zone A. Simultaneously, of course, the solids and gases in the cooling zone D were progressively cooled as they moved between its second and first ends.

Two gas compressor and conduit assemblies 30, 31 were provided to suction gases from the first end of the preheat zone A and the second end of the vaporization zone B, respectively. A fan and conduit assembly 32, was provided to suction gases from the first end of the cooling zone D.

The gases removed from the preheat zone A through assembly 30 were condensed in a first condenser 33. The non-condensed gases 40, consisting mostly of air, were routed to the combustion zone C for combustion. The gases removed from the vaporization zone B through assembly 31 were condensed in a second condenser 20. Non-condensible gases 34 from the second condenser 20 are optionally burned as a supplemental fuel or are burned in a flare stack 39. The flue gases were removed by the assembly 32 from the first end of the cooling zone D, were cleaned in entrained solids removal equipment 41 (not detailed), and were vented from a stack 42.

The cooled solids issuing from the first end of the cooling zone D passed through an outlet 35 in the second end frame 8 and were discharged by conveyor assemblies 36 as tailings 44.

The invention is now exemplified by a series of examples describing pilot runs conducted on average oil sands using the ATP processor just described.

EXAMPLE I

This first example clearly distinguishes the differing characteristics of the combustion zone of the ATP processor from the processes of the prior art. Powell et al achieves high sulfur capture using CaO addition to coke combustion processes. When CaO is directly added to the combustion zone of the ATP processor, in accordance with the prior art, sulfur reduction is not suitably achieved as described below.

Oil sand containing about 11 weight % bitumen was fed at 4.0 tonnes/hour into the ATP processor. The bitumen contained about 5 weight % elemental sulfur for a feed rate of 22 kg/hr of sulfur. A baseline operation was established, with partial combustion of the available coke to produce flue gas emissions having about 2700 ppm of $SO_2$. The vaporization temperature was about 500° C. and the combustion temperature was about 700° C.

CaO was then added directly to the combustion zone at rates ranging from 25 to 50 kg/hour. This is equivalent to an elemental calcium rate of about 18 to 36 kg/hr.

$SO_2$ contained in the flue gas stream was only reduced to about 1000 ppm for a sulfur capture of about 60%. The $SO_2$ emission was not sufficiently reduced to consider eliminating any flue gas desulfurization equipment.

EXAMPLE II

This second example illustrates the method of the invention wherein substantially all sulfur containing gases were successfully removed from the flue gas stream.

Oil sand containing 11.1% bitumen was fed to the ATP processor at about 4.1 tonnes/hour. The bitumen contained about 5.3 weight % elemental sulfur for a feed rate of 24 kg/hr of sulfur. A baseline operation was established, with partial combustion of the available coke to produce flue gas emissions having about 4400 ppm of $SO_2$. The vaporization temperature was about 510° C. and the combustion temperature was about 700° C.

The mass balance of sulfur was typically:

35% to the condensed oils.

9% to the non-condensed hydrocarbons as $H_2S$.

21% remaining the non-combusted coke.

33% appearing in the flue gas as $SO_2$.

Quick lime, with an apparent bulk density of 881 kg/m$^3$, was used to provide the CaO, having the following characteristics:

| | Weight | Particle Size Distribution | |
|---|---|---|---|
| Analysis | % | Mesh | % passing |
| $SiO_2$ | 0.2 | 100 | 94.0 |
| $Fe_2O_3$ | 0.1 | 200 | 70.0 |
| $Al_2O_3$ | 0.1 | 325 | 52.0 |
| Sulfur | 0.01 | | |
| Moisture | 0.0 | | |
| $P_2O_5$ | 0.1 | | |
| LOI | 2.8 | | |
| MgO | 2.9 | | |
| CaO | 92.8 with available CaO at 90.2% | | |

CaO was then added to the oil sand feed entering the ATP processor at rates ranging from 10 to 57 kg/hour. This is equivalent to an elemental calcium rate of about 7 to 41 kg/hr. Due to the high circulating steam load, it is likely that at least a portion of the CaO is hydrated as follows:

$$CaO+H_2O \rightarrow Ca(OH)_2 \quad (1)$$

Figure 2:
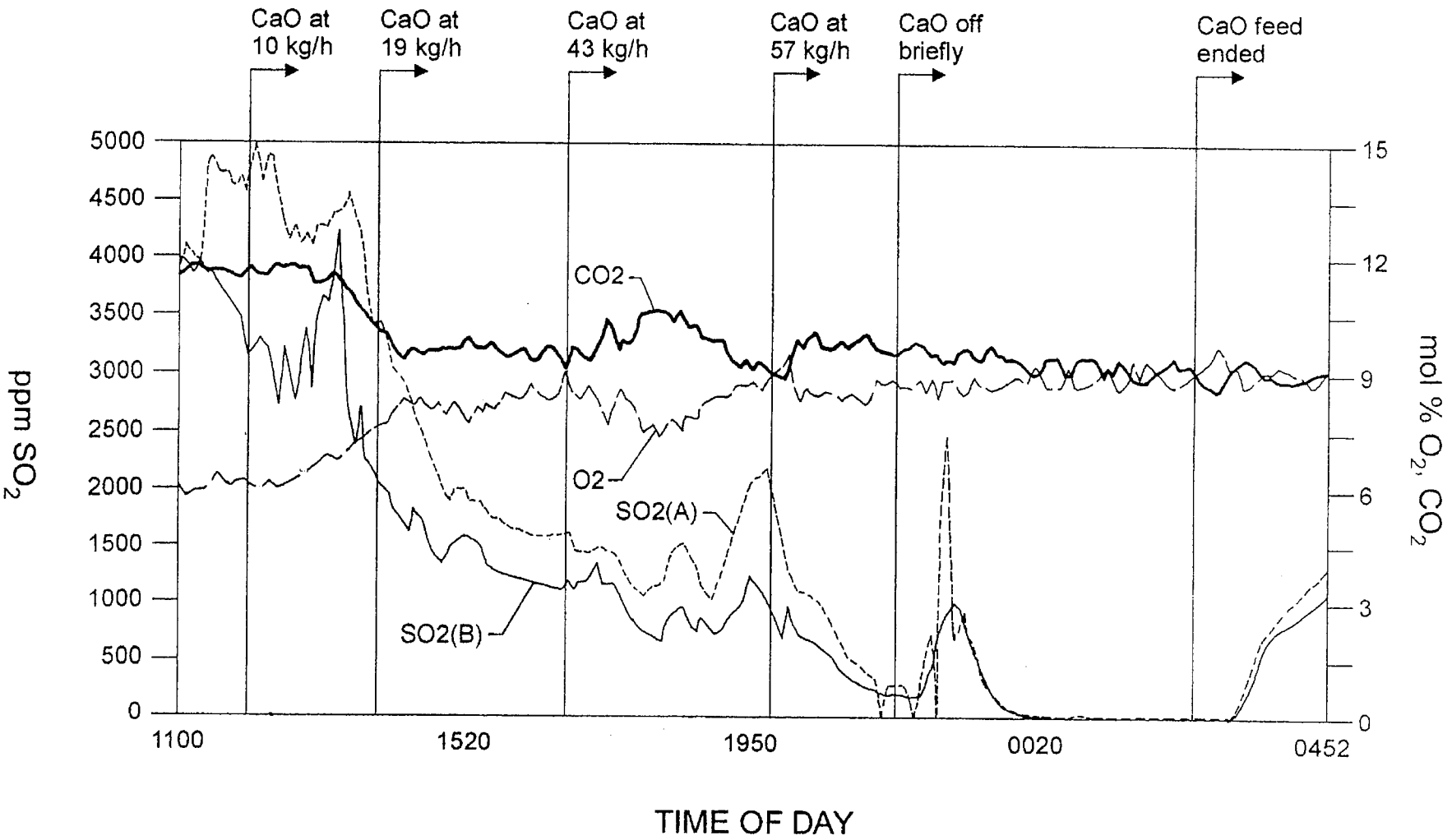
FIG. 2 is a graph depicting a progressive increase in the capture of $SO_2$ with increasing added amounts of CaO.

Having reference to FIG. 2, the oxygen ("$O_2$"), carbon dioxide ("$CO_2$"), and $SO_2$ present in the flue gas is presented during the run. As shown, rates of less than 57 kg/hr were not completely successful in capturing all the sulfur. At rates of 57 kg/hr, the flue gas $SO_2$ was reduced to less than detectable. Substantially all $SO_2$ was captured at a molar ratio of calcium to sulfur in the feed, Ca:S of about 1.3:1.

A typical mass balance of sulfur after addition of CaO is as follows:

30% to the condensed oils.

6% to the non-condensed hydrocarbons as hydrogen sulfide ("$H_2S$").

33% remaining with the non-combusted coke as sulfur.

0% appearing in the flue gas as $SO_2$.

31% as the balance, not measured, but presumably present in the non-combusted coke as product $CaSO_4$.

It can be inferred from the reduction in $H_2S$ that some sulfur was captured in the vaporization zone in small amounts. The following reactions may have occurred during pyrolization:

$$CaO+H_2S \rightarrow CaS+H_2O \quad (2)$$

$$Ca(OH)_2+H_2S \rightarrow CaS+2H_2) \quad (3)$$

Figure 3:
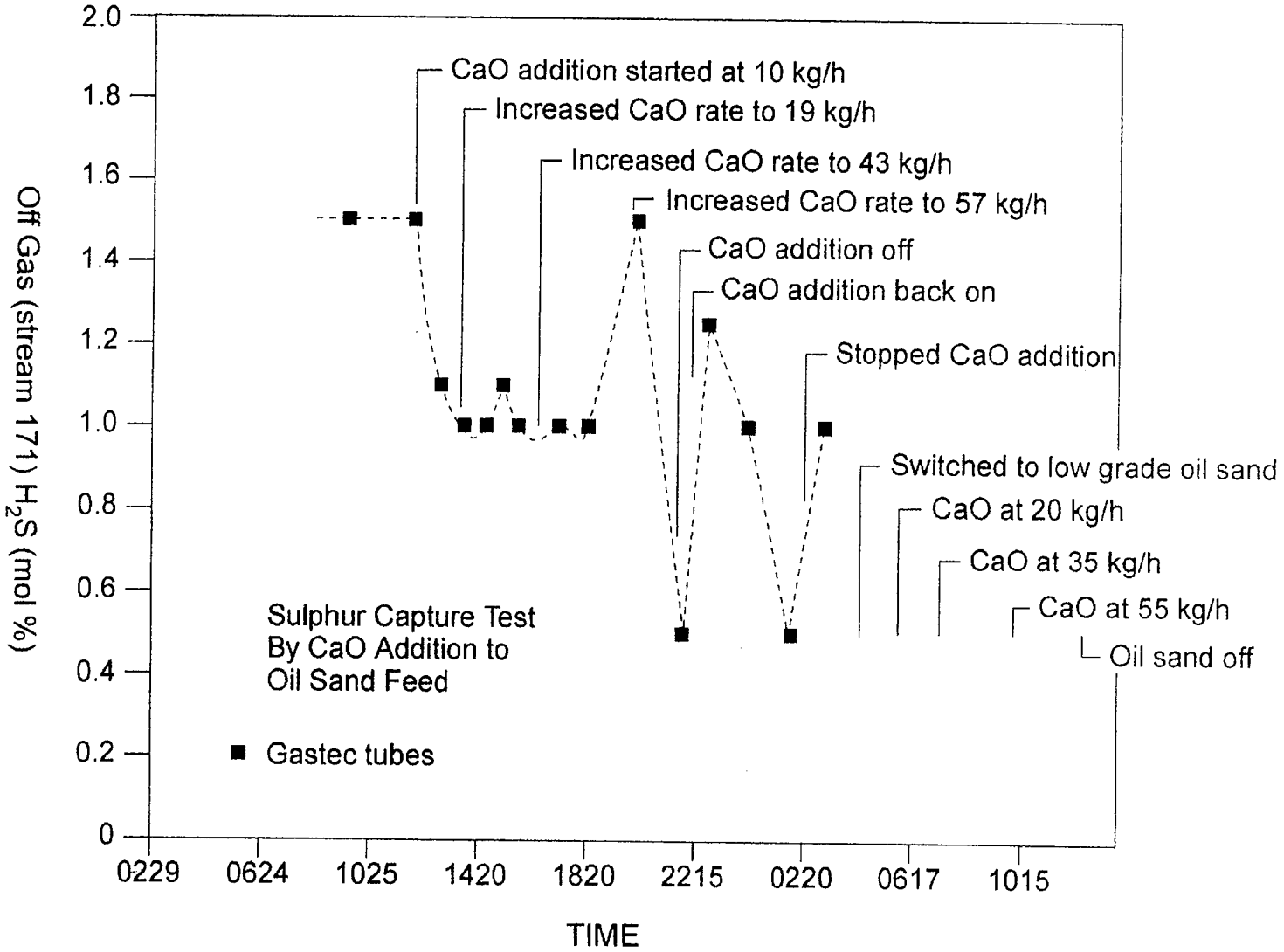
FIG. 3 is a graph depicting a progressive increase in the capture of $H_2S$ with increasing added amounts of CaO.

Referring to FIG. 3, a specific case is shown in which a 66% reduction in the sulfur was achieved in the gases that were extracted from the vaporization zone. Sulfur was produced as $H_2S$ which was subsequently captured, reducing it from 15000 ppm to about 5000 ppm in the gas stream.

During combustion of the modified coke, two mechanisms could have then occurred to prevent the production of $SO_2$ upon combustion.

First, CaS (calcium sulfide) may have reacted with oxygen to form a stable solid product, calcium sulfate ("$CaSO_4$") as shown:

$$CaS+2O_2 \rightarrow CaSO_4 \quad (4)$$

As the experiment of EXAMPLE I demonstrated, gas phase interaction of released $SO_2$ and CaO delivered in the flue gas stream was not sufficiently effective to capture the sulfur. Thus, secondly, it was likely that CaO, associated with the coked solids, capture $SO_2$ evolving from the coke in a surface reaction before it reaches the flue gas. CaO and $SO_2$ may have reacted in the known reaction as follows:

$$CaO + SO_2 + \frac{1}{2} O_2 \rightarrow CaSO_4 \quad (5)$$

Any calcium hydroxide formed in the preheat and vaporization zones has an opportunity to revert to CaO again at temperature in excess of about 580° C. as shown:

$$Ca(OH)_2 + 580° C. \rightarrow CaO + H_2O \quad (6)$$

which makes more CaO available for the above capture of $SO_2$.

The above operation was accomplished in a transportable processing plant implementation of the ATP processor system. The processor had an overall length of about 8.6 meters and an outer diameter of 3.1 meters. The transportable ATP processor was characterized by the following operating parameters:

- preheat zone defined by about 4.8 meters in length and 1.8 meters in diameter;
- vaporization zone defined by about 1.5 meters in length and 1.8 meters in diameter;
- an annular space defined by the outside diameters of the preheat and vaporization zones and the inner diameter of the refractory lined outer tubular member;
- a combustion zone defined by an inner diameter of 1.8 meters, an outer diameter of 3.0 meters and an overall length of 3.6 meters;
- a cooling zone defined by an inner diameter of 1.9 meters, an outer diameter of 3.0 meters and an overall length of 3.6 meters;
- preheat zone wall thickness being 18 millimeters and an overall solids retention time in the preheat zone being 15 to 20 minutes;
- the preheat zone temperature profile being observed as about 20° C. (ambient) at the first end, characteristically rising swiftly to 100° C. as the water boils off, remaining at such temperature until such time as all the water is evaporated, after which the temperature again climbs to about 270° C.;
- the cooling zone profile being roughly linear from 690° C. at the second end to 400° C. at the first end or tailings discharge point;
- the suction pressure on the preheat zone being slightly subatmospheric at −0.09 mmHG;
- the suction pressure on the vaporization zone being −0.24 mmHG;
- the suction pressure on the annular space being −0.19 mmHG;
- the recycle solids flow being about 1.75 times the preheat exit solids flow for a rate of about 7000 kg/hour;
- the recycle solids temperature being 720° C.; and
- the resultant vaporization zone temperature being 510° C.

The embodiments of the invention in which an exclusive property or privilege is claimed are defined as follows:

1. In a continuous process comprising treating oil sand comprising sand associated with water and bitumen hydrocarbons containing sulfur in a rotating kiln-type processor to recover hydrocarbons, said oil sand being subjected to sequential preheating, vaporization and combustion steps therein, whereby flue gases are produced in the combustion step, the improvement comprising:

continuously adding calcium oxide to the oil sand feed prior to or during the preheating step, said calcium oxide being added in an amount corresponding to a molar ratio of calcium to sulfur in the feed greater than 1:1, so that production of sulfur dioxide in the flue gases is reduced.

2. A continuous process according to claim 1, said processor comprising an inner tubular member, forming an internal passageway comprising sequential preheat and vaporization zones extending between said member's first and second ends, and an outer tubular member having first and second ends corresponding with those of the inner tubular member, said outer tubular member being generally coextensive, concentric and radially spaced outwardly from the inner tubular member to form an annular passage between them which provides sequential combustion and cooling zones extending between the outer tubular member's second and first ends, said tubular members being rotatable together whereby particulate solids of the feed may be cascaded and advanced through the preheat and vaporization zones and back through the combustion and cooling zones, said processor having a baffle separating the preheat and vaporization zones, chute means for enabling the particulate solids to move through the baffle from the preheat zone to the vaporization zone, first fan and conduit means for suctioning gases from the first end of the preheat zone, second fan and conduit means for suctioning gases from the vaporization zone, chute means for recycling hot particulate solids from the first end of the combustion zone to the first end of the vaporization zone, closure plate for closing the second end of the inner tubular member, stationary end frame for closing the first ends of the inner tubular member, stationary end frames for closing the first and second ends of the outer tubular member, means for injecting air into the combustion zone, burner means for supplying supplemental heat to the combustion zone, means for lifting and dropping particulate solids in the combustion zone, means for lifting and dropping the particulate solids in the cooling zone whereby they contact the preheat portion of the inner tubular member to heat its wall, means for supplying the hydrocarbon-bearing particulate solids into the preheat zone, means for removing cooled particulate solids from the first end of the cooling zone, and third fan and conduit means for suctioning gases from the first end of the cooling zone, said processor being associated with condensing means adapted to receive and condense hot gases suctioned from the vaporization zone, said process comprising:

(a) adding calcium oxide to the particulate feed stream to provide feed for the processor in an amount corresponding to a molar ratio of calcium to sulfur in the feed of greater than 1:1;

(b) advancing the feed through the preheat zone while simultaneously cascading it and progressively heating it by heat exchange with the wall of the inner tubular member, so that the calcium oxide forms a mixture with the sulfur-containing hydrocarbons and particulate feed;

(c) further advancing the preheated feed mixture through the baffle and into the vaporization zone and mixing it therein with recycled hot solids to raise the temperature of the feed to a temperature sufficient to pyrolyse contained oil and produce coked solids which are modified by the calcium so that the coked solids are substantially prevented from producing sulfur dioxide gas upon combustion with air;

(d) suctioning produced gases from the vaporization zone, which contain a portion of the sulfur originally associated with the feed, and condensing them to yield liquid condensate and some non-condensibles;

(e) discharging the coked solids from the vaporization zone into the combustion zone;

(f) lifting and dropping the coked solids in the combustion zone and combusting and heating them by contacting them with injected air and added supplemental heat, to produce hot solids having a temperature of at least about 650° F. and flue gases, substantially free of sulfur dioxide;

(g) advancing the hot solids through the combustion zone and recycling a sufficient portion of them into the first end of the vaporization zone to heat the feed as previously stated in accordance with step (c);

(h) advancing the balance of the hot solids through the cooling zone and lifting and dropping them onto the preheat section of the inner tubular member, whereby the wall of the preheat section of the inner tubular member is heated by contact with the hot solids and flue gas moving through the cooling zone;

(i) discharging cooled solids from the first end of the cooling zone; and (j) suctioning produced flue gases from the annular space using the third fan and conduit means, said gases being substantially free of sulfur dioxide.

3. A process according to claim 1, wherein the molar ratio of calcium to sulfur is about 1.3:1.

4. A process according to claim 1, wherein said preheating step comprises continuous cascading of the oil sand feed and the calcium oxide, and hydrating a portion of the calcium oxide to calcium hydroxide.

5. A process according to claim 4, further comprising advancing the resultant preheated mixture of oil sand, calcium oxide and calcium hydroxide to the vaporization step and mixing it with a recycle stream of hot coked solids, to raise the temperature of the feed stream sufficiently so that hydrocarbons are pyrolysed and resultant pyrolysed hydrocarbons are suctioned from the zone as a gas, thereby separating the hydrocarbons from coked product on the solids, the calcium oxide and calcium hydroxide reacting so as to become intimately associated in a modified calcium product form with the coked product.

6. A process according to claim 5, wherein after pyrolization, the resultant coked product is combusted in the combustion zone, the modified calcium product acting to capture substantially all of the sulfur released from the combusted coke to yield a flue gas product substantially free of $SO_2$, and a stable calcium-sulfur product associated with the solids.

7. A process according to claim 6, wherein the molar ratio of calcium to sulfur is about 1.3:1.

8. A process according to claim 7, wherein the molar ratio of calcium to sulfur is about 1.3:1.

9. A process according to claim 6, devoid of a step to remove sulfur dioxide from flue gases leaving the processor.

10. A process according to claim 1, devoid of a step to remove sulfur dioxide from flue gases leaving the processor.

11. A process according to claim 1, wherein the molar ratio of calcium to sulfur is about 1.3:1.

* * * * *